US011585622B1

(12) United States Patent
Duque et al.

(10) Patent No.: US 11,585,622 B1
(45) Date of Patent: Feb. 21, 2023

(54) MICROWAVE IGNITION SYSTEMS WITH LAUNCHER AFFIXED TO OR LOCATED WITHIN A GUN SPINDLE

(71) Applicant: Triad National Security, LLC, Los Alamos, NM (US)

(72) Inventors: Amanda Lynn Duque, Los Alamos, NM (US); William Lee Perry, Los Alamos, NM (US)

(73) Assignee: Triad National Security, LLC, Los Alamos, NM (US)

( * ) Notice: Subject to any disclaimer, the term of this patent is extended or adjusted under 35 U.S.C. 154(b) by 276 days.

(21) Appl. No.: 16/864,021

(22) Filed: Apr. 30, 2020

Related U.S. Application Data

(63) Continuation-in-part of application No. 15/491,314, filed on Apr. 19, 2017, now Pat. No. 10,641,572.

(60) Provisional application No. 62/324,846, filed on Apr. 19, 2016.

(51) Int. Cl.
*F41A 19/63* (2006.01)
*F42B 5/08* (2006.01)

(52) U.S. Cl.
CPC ..... *F41A 19/63* (2013.01); *F42B 5/08* (2013.01)

(58) Field of Classification Search
CPC ..... F41A 19/58; F41A 19/63; F42B 5/08
See application file for complete search history.

(56) References Cited

U.S. PATENT DOCUMENTS 3,601,054 A 8/1971 Christianson
5,146,044 A 9/1992 Kurokawa et al.
5,272,828 A 12/1993 Petrick et al.
6,152,039 A 11/2000 Lee
6,591,753 B1 7/2003 Schmid et al.
8,387,534 B1 3/2013 Imholt
9,097,503 B1 8/2015 Perry, III
9,829,297 B2 11/2017 Graswald
10,107,607 B1 * 10/2018 Burke ..... F42C 13/045
10,641,572 B1 * 5/2020 Perry ..... F42C 19/12
10,859,358 B1 * 12/2020 Burke ..... F42B 5/38
(Continued)

FOREIGN PATENT DOCUMENTS

CN 112945032 A * 6/2021
DE 3810048 A1 * 10/1989
(Continued)

OTHER PUBLICATIONS

James S Bergin, "Non-Final Office Action", dated Sep. 9, 2019, U.S. Appl. No. 15/491,314.
(Continued)

*Primary Examiner* — Gabriel J. Klein
(74) *Attorney, Agent, or Firm* — LeonardPatel PC; Michael A. Leonard, II; Sheetal S. Patel

(57) ABSTRACT

Microwave ignition systems with a launcher affixed to or located within a gun spindle. Use of a planar, impedance matched system that include a launcher affixed to or located within a gun spindle and a receiver affixed the propelling charge, where the receiver is engineered and impedance matched to efficiently deposit energy into the receiving igniter material, may result in significantly better timing and reliability than conventional mechanical gun ignition systems and other microwave ignition systems. A pressure-tolerant feed through system can route the microwave energy to the inside of the breech.

18 Claims, 19 Drawing Sheets

(56) References Cited

U.S. PATENT DOCUMENTS

| | | | | |
|---|---|---|---|---|
| 10,969,206 | B1 * | 4/2021 | Burke | F42B 5/08 |
| 2014/0013982 | A1 | 1/2014 | Meir et al. | |
| 2014/0306065 | A1 * | 10/2014 | Palmer | F42B 15/12 244/171.1 |
| 2018/0051657 | A1 | 2/2018 | Villarreal et al. | |

FOREIGN PATENT DOCUMENTS

| | | | | |
|---|---|---|---|---|
| DE | 60011959 | | 8/2005 | |
| EP | 1067354 | A1 * | 1/2001 | C06B 45/12 |
| FR | 2702832 | A1 | 9/1994 | |
| GB | 2234335 | A * | 1/1991 | F41A 19/63 |
| GB | 2241563 | A * | 9/1991 | F02K 9/95 |
| HU | E029254 | T2 * | 2/2017 | |
| RU | 2348004 | C2 | 2/2009 | |
| RU | 2631518 | C2 | 9/2017 | |
| WO | WO-9511420 | A1 * | 4/1995 | F41A 19/63 |
| WO | 2005043069 | A1 | 5/2005 | |

OTHER PUBLICATIONS

James S Bergin, "Notice of Allowance", dated Jan. 17, 2020, U.S. Appl. No. 15/491,314.
James S Bergin, "Non-Final Office Action", dated Jun. 27, 2022, U.S. Appl. No. 16/864,047.

* cited by examiner

MICROWAVE IGNITION SYSTEMS WITH LAUNCHER AFFIXED TO OR LOCATED WITHIN A GUN SPINDLE

CROSS REFERENCE TO RELATED APPLICATIONS

This application is a continuation-in-part of U.S. Non-provisional patent application Ser. No. 15/491,314 filed Apr. 19, 2017, which claims the benefit of U.S. Provisional Patent Application No. 62/324,846, filed on Apr. 19, 2016. The subject matter of these earlier filed patent applications is hereby incorporated by reference in its entirety.

STATEMENT OF FEDERAL RIGHTS

The United States government has rights in this invention pursuant to Contract No. 89233218CNA000001 between the United States Department of Energy and Triad National Security, LLC for the operation of Los Alamos National Laboratory.

FIELD

The present invention generally relates to microwave ignition systems, and more particularly, to microwave ignition systems with a launcher affixed to or located within a gun spindle.

BACKGROUND

Medium and large caliber gun systems typically use a mechanical firing mechanism in which the firing pin comes into direct contact with each shell or cartridge to be fired. Because this requires a number of moveable parts, relies on physical contact to function properly, and the breech environment of gun systems is subject to extreme heat and forces, there is risk of mechanical failure. Also, the mechanism is subject to wear and deterioration of performance over time. Such gun systems are generally also not versatile with respect to changes in the primer or propellant material. Firing timing requirements in gun systems are stringent, and seemingly small changes in a material composition or identity will often result in improper function of the gun that begins with the mechanism through which the energetic material is initiated. Accordingly, an improved system may be beneficial.

SUMMARY

Certain embodiments of the present invention may provide solutions to the problems and needs in the art that have not yet been fully identified, appreciated, or solved by conventional microwave ignition system technologies. For example, some embodiments of the present invention pertain to microwave ignition systems with a launcher affixed to or located within a gun spindle.

In an embodiment, a spindle for a microwave ignition system includes a spindle body and a microwave power source provided through the spindle body. The spindle also includes a driver configured to emit microwave energy. The driver is operably connected to the microwave power source. The spindle further includes a first ceramic plate covering the driver.

In another embodiment, a spindle includes a microwave power source and a driver configured to emit microwave energy. The driver is operably connected to the microwave power source. The spindle further includes an inner ceramic plate housing the driver and an outer ceramic plate covering the driver and the inner ceramic plate.

In yet another embodiment, a gun spindle includes a driver configured to emit microwave energy. The gun spindle also includes an inner ceramic plate housing the driver and an outer ceramic plate covering the driver and the inner ceramic plate. The gun spindle further includes a launcher plate including a ceramic plate recess. The ceramic plate recess houses the outer ceramic plate. The gun spindle includes a front face portion and the launcher plate abuts the front face portion of the gun spindle.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

Unless otherwise indicated, similar reference characters denote corresponding features consistently throughout the attached drawings.

DETAILED DESCRIPTION OF THE EMBODIMENTS

Some embodiments of the present invention pertain to microwave ignition systems with a launcher affixed to or located within a gun spindle. The launcher is also referred to as a driver herein. Use of a planar, impedance matched system that include a launcher affixed to or located within a gun spindle and a receiver affixed to the propelling charge, where the receiver is engineered and impedance matched to efficiently deposit energy into the receiving igniter material, may result in significantly better timing and reliability than conventional mechanical gun ignition systems and other microwave ignition systems. A pressure-tolerant feed through system may route the microwave energy to the inside of the breech in some embodiments. Such embodiments may be particularly useful for large bore artillery, but may be used for any caliber gun system without deviating from the scope of the invention.

The use of microwave energy for ignition of gun primers and propellants may be advantageous over conventional mechanical systems because material performance and/or output energy may be enhanced due to the nature of microwave energy deposition. Also, materials of conventional sensitivity may be replaced with less sensitive, safer materials that will not ignite or react sufficiently under standard ignition techniques. Furthermore, a microwave firing system eliminates the complexity and delays caused by the loading of a mechanical primer and mechanical percussion by the firing pin.

Figure 1:
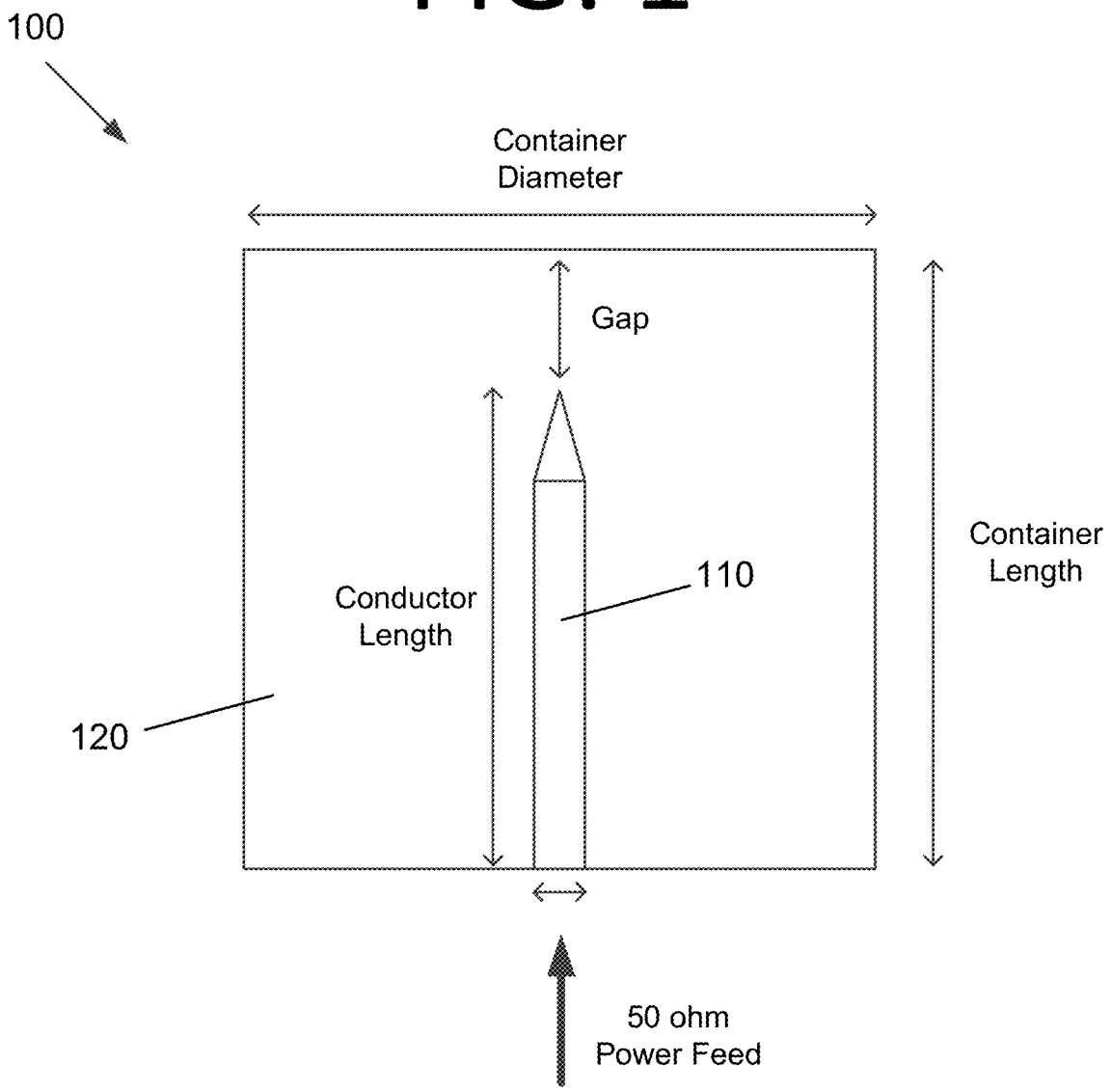
FIG. 1 is a cross-sectional view illustrating a cylindrical igniter assembly, according to an embodiment of the present invention.
Figure 2A:
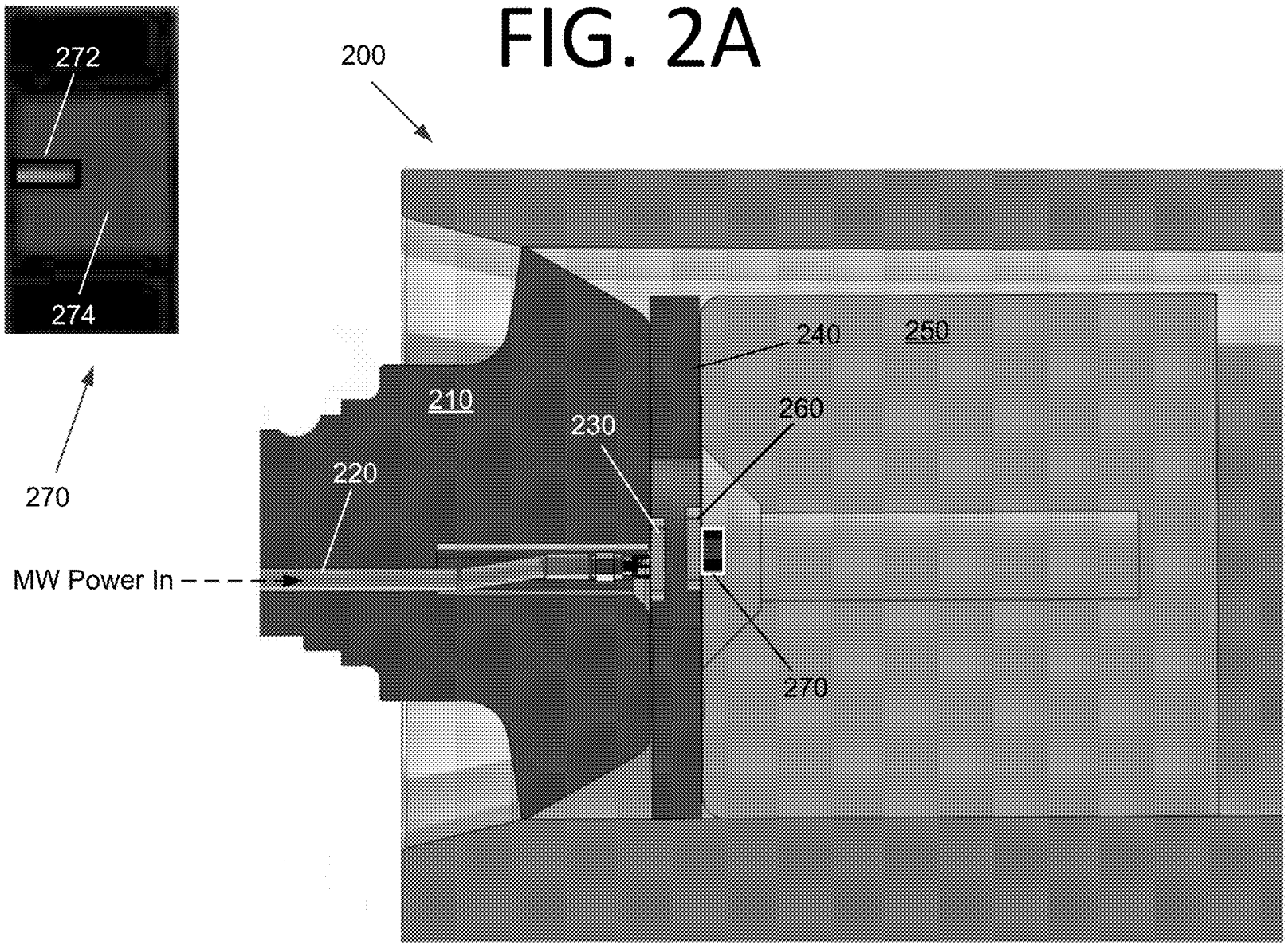
FIG. 2A is a side cutaway view illustrating a portion of a gun with a microwave ignition system, according to an embodiment of the present invention.
Figure 2B:
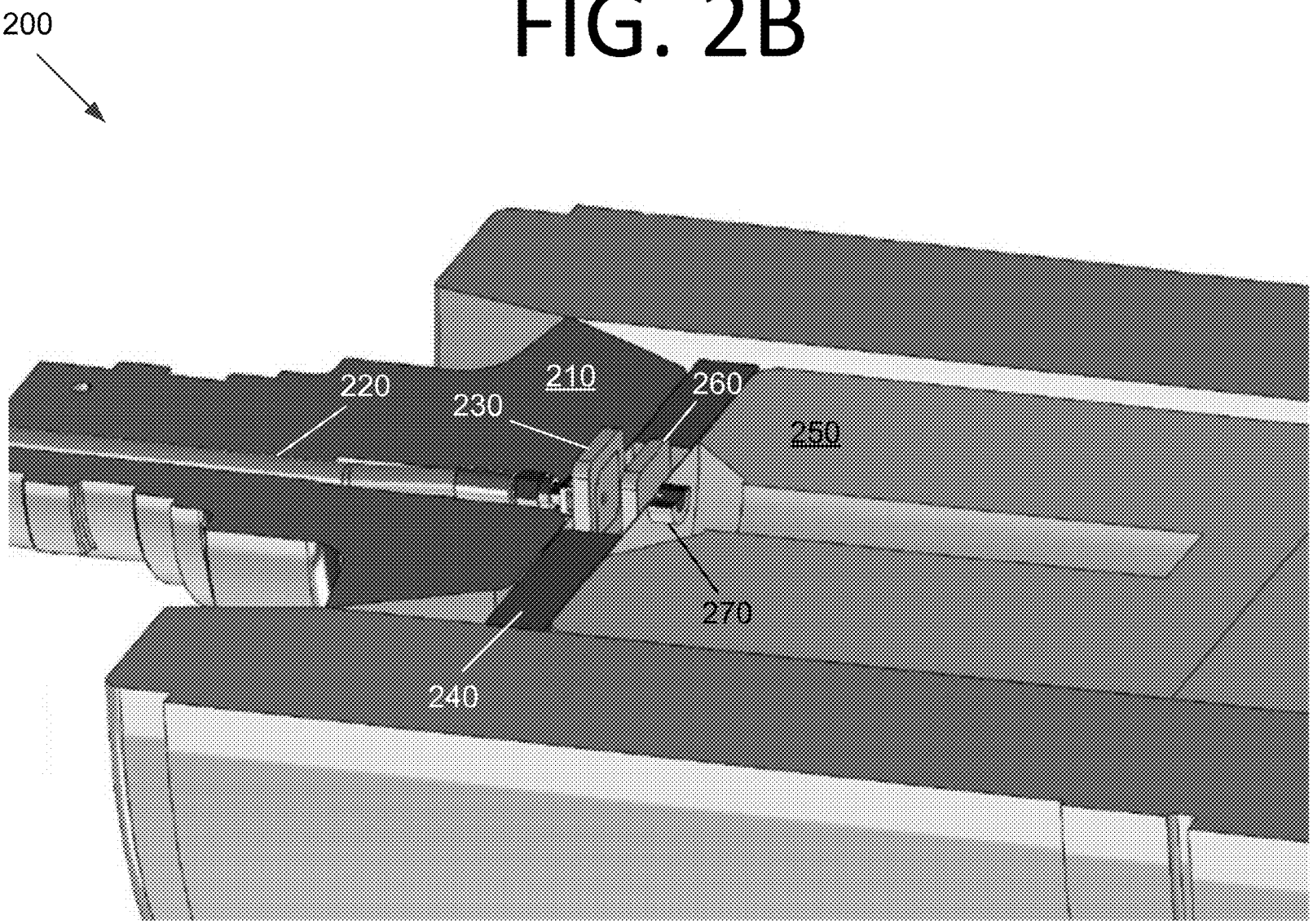
FIG. 2B is a perspective cutaway view illustrating a portion of the cannon with the microwave ignition system of FIG. 2A, according to an embodiment of the present invention.
Figure 2C:
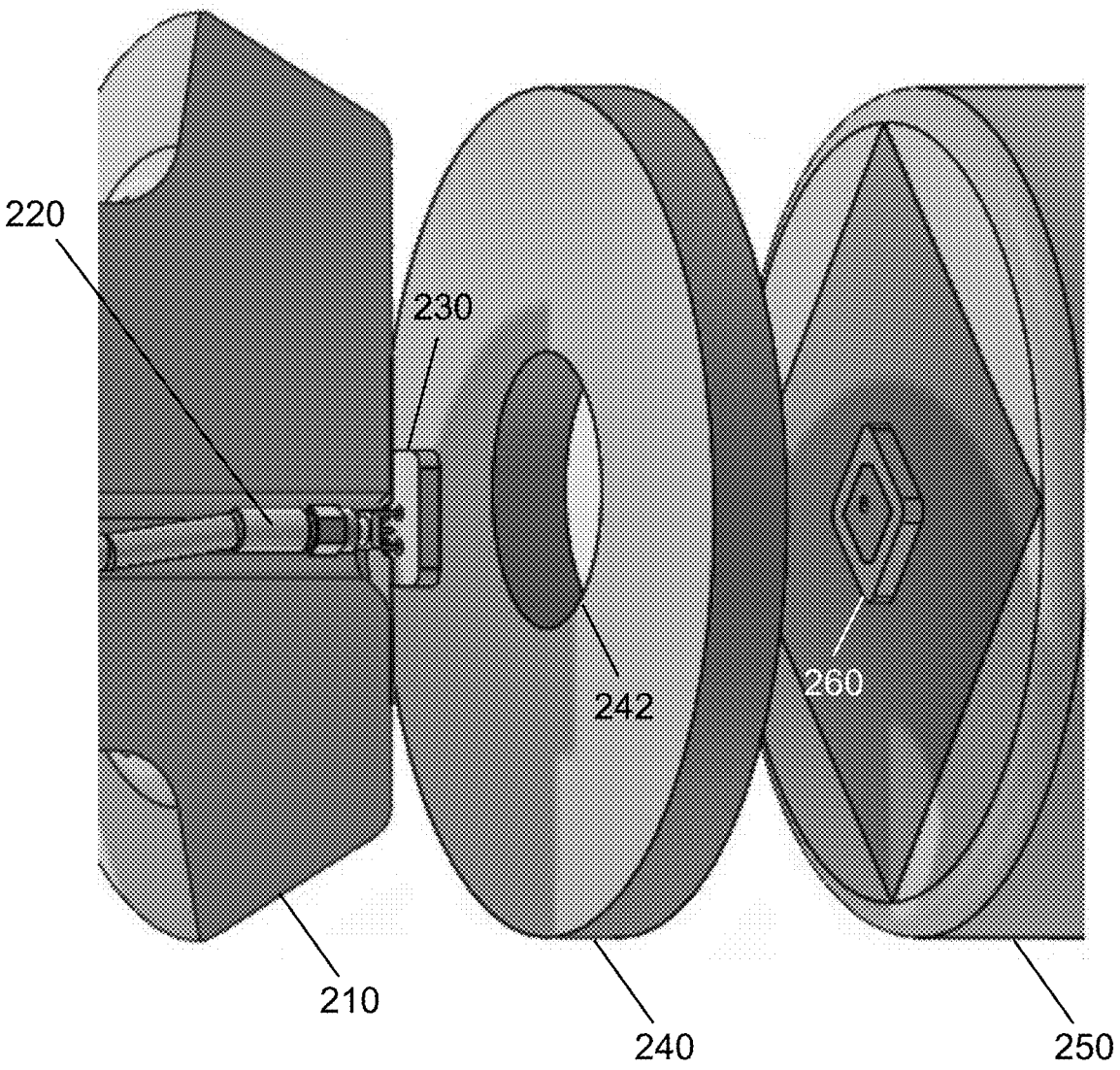
FIG. 2C is a partial separated view illustrating a portion of the cannon with the microwave ignition system of FIG. 2A, according to an embodiment of the present invention.
Figure 2D:
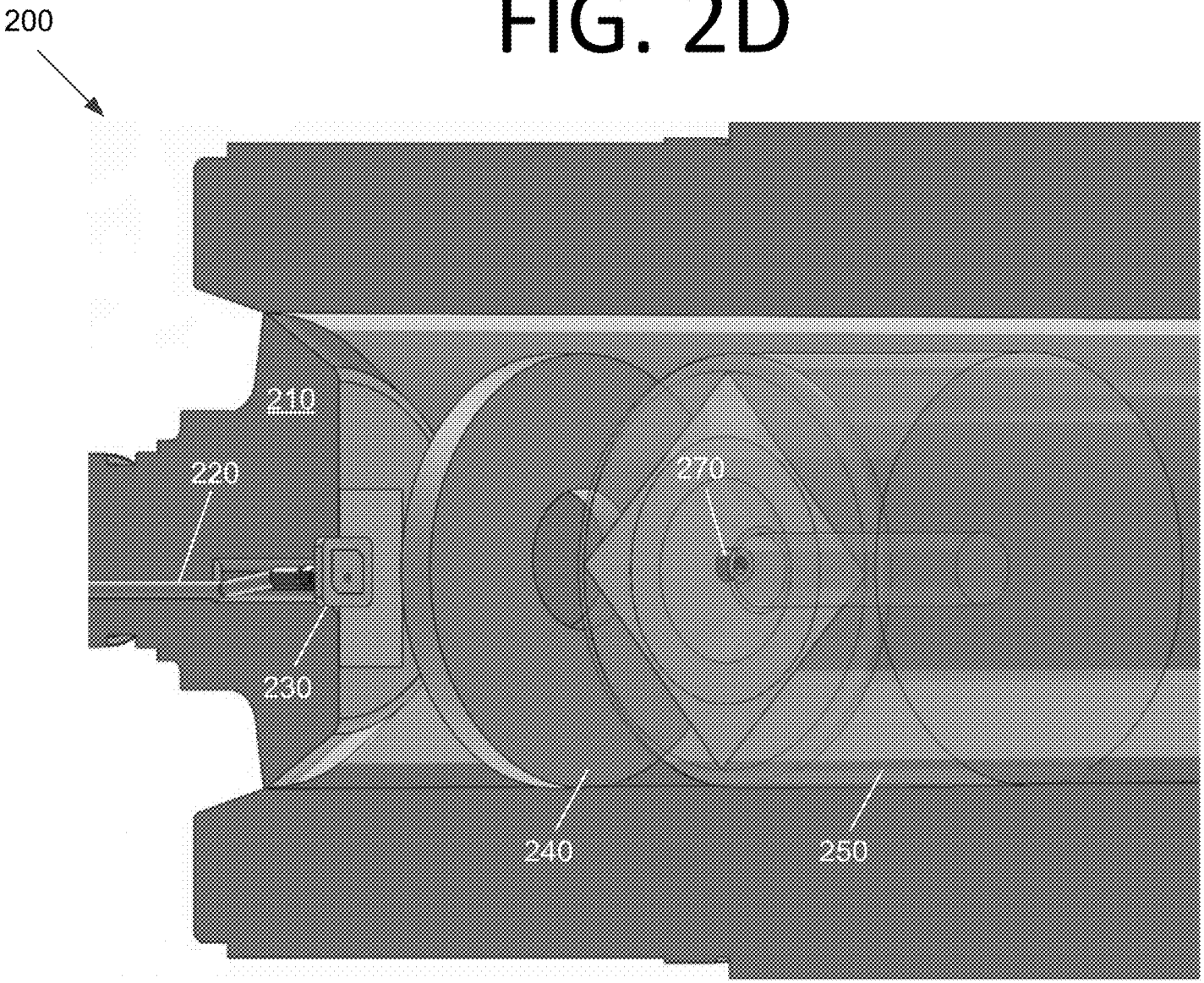
FIG. 2D is a side perspective cutaway view illustrating a portion of the cannon with the microwave ignition system of FIG. 2A, according to an embodiment of the present invention.

Impedance matching should consider the shape and size of the feed conductor from the receiving element, the dielectric properties of the igniter charge, and the shape and size of the igniter charge container as a system to efficiently ignite the material. FIG. 1 is a cross-sectional view illustrating a cylindrical igniter assembly 100, according to an embodiment of the present invention. Cylindrical igniter assembly includes a 50 ohm conductor 110 and igniter material 120. For this example, consider a receiver designed to transfer its received power onto conductor 110. Conductor 110 could be designed as 50 ohm coaxial terminator, where cylindrical igniter assembly 100 holds igniter material 120 in a cylindrical container. There is a straightforward mathematical relationship amongst the diameter of the container, the diameter of the ignition probe (i.e., conductor 110), and the dielectric properties of igniter material 120. Using an impedance matched launcher and receiver system may provide a more effective microwave ignition system.

FIGS. 2A-D illustrate a portion of a gun 200 with a microwave ignition system, according to an embodiment of the present invention. Gun 200 includes a spindle 210. Within spindle 210, a cable 220 provides microwave power to a launcher 230, which functions as a microwave transmitter. In some embodiments, launcher 230 may include a planar antenna, which may be a microstrip antenna, a patch antenna, or any other suitable antenna without deviating from the scope of the invention. Launcher 230 extends from the spindle side into a hole or recessed portion 242 in a foam spacer 240. A charge 250 (e.g., a Modular Artillery Charge System (MACS) charge in some embodiments) includes a microwave receiver 260 (e.g., a planar receiver) on an end of charge 250 closest to spindle 210. Microwave receiver 260 extends into hole or recessed portion 242 of foam spacer 240 and receives microwave energy transmitter by launcher 230. Microwave receiver 260 is operably connected to an igniter cup 270 (e.g., a brass cup) that houses an igniter charge 274 (e.g., thermite) and an antenna 272.

Figure 3A:
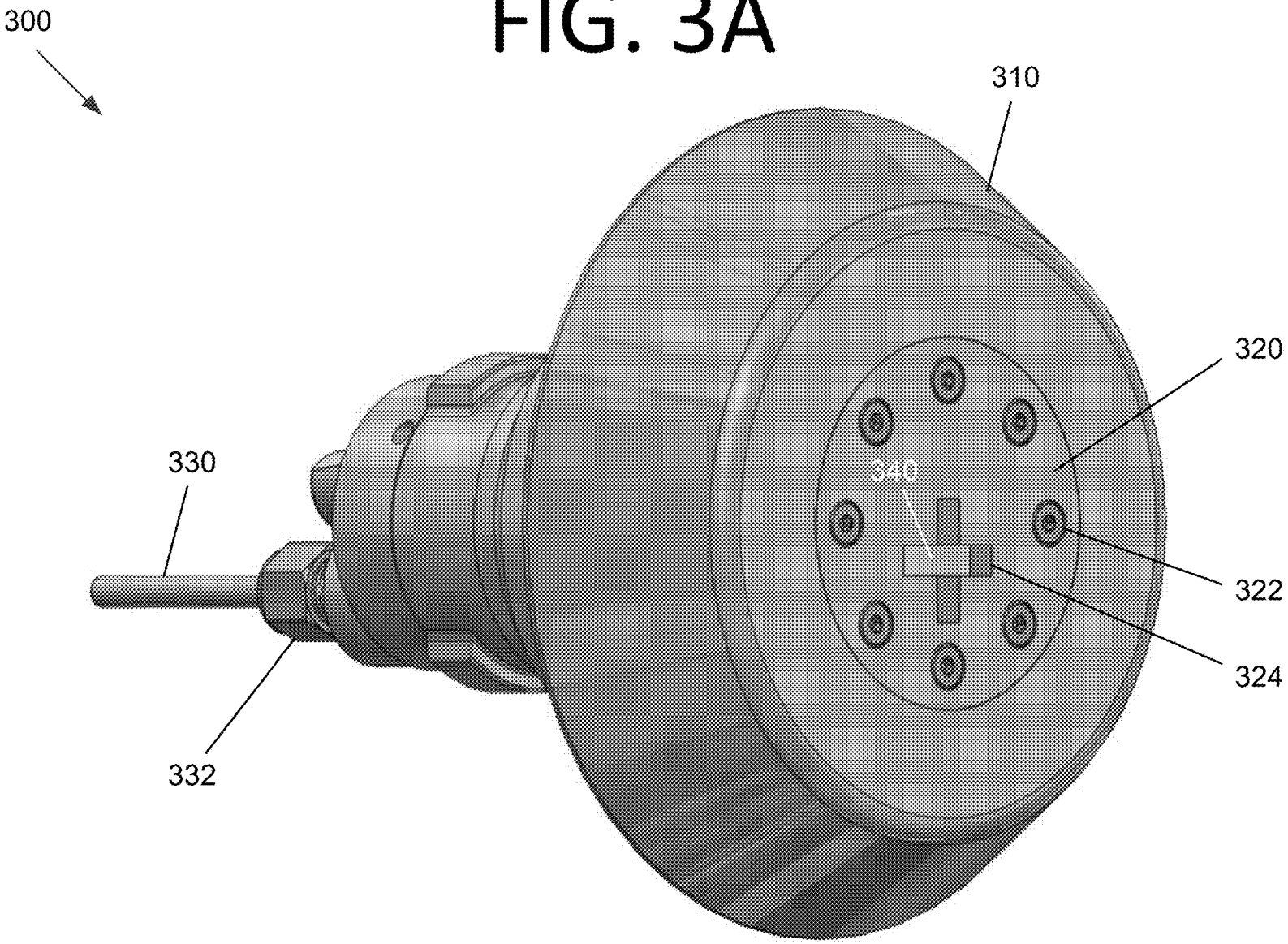
FIG. 3A is a side perspective view illustrating a spindle, according to an embodiment of the present invention.
Figure 3B:
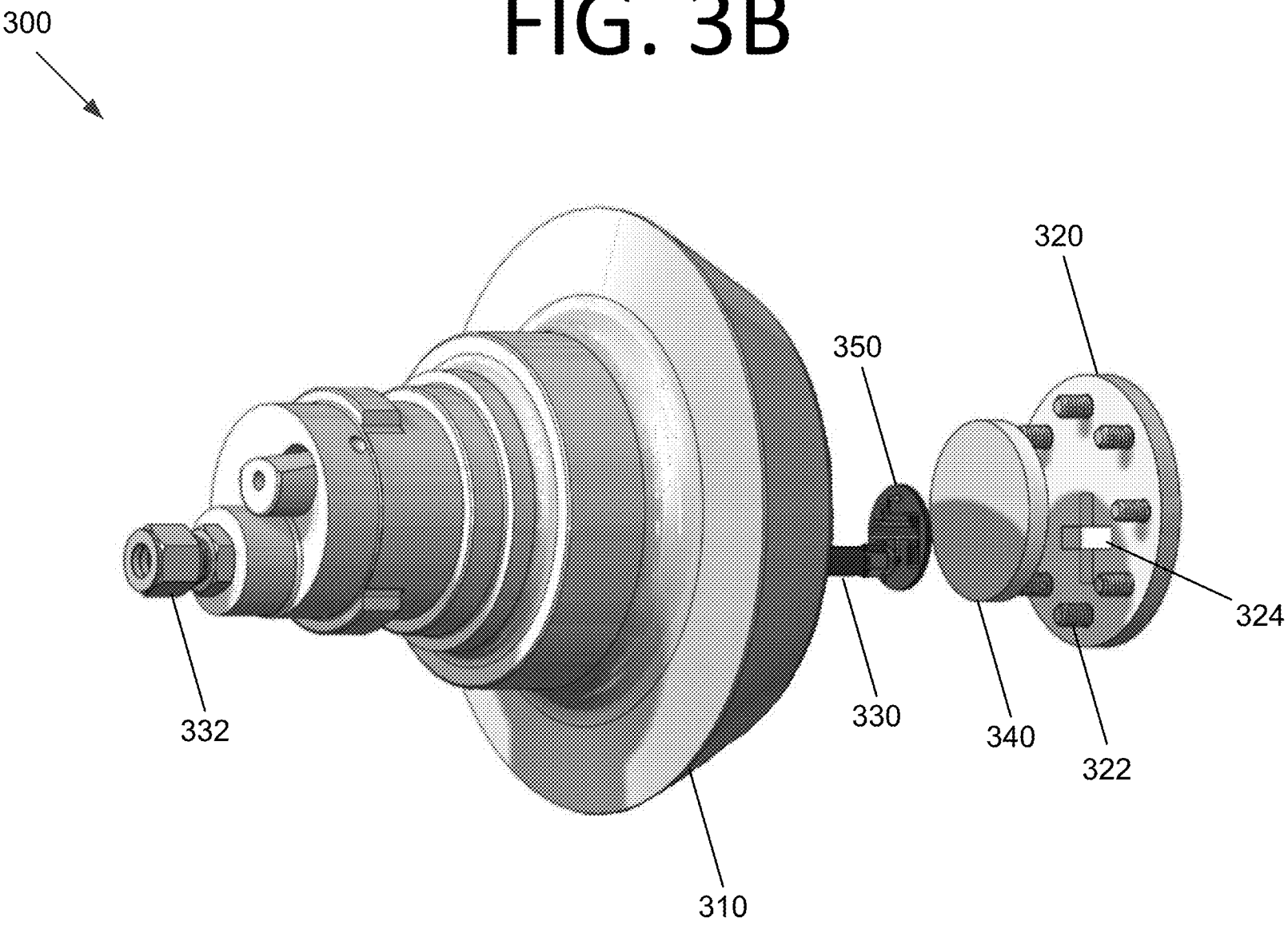
FIG. 3B is a partially separated side perspective view illustrating the spindle of FIG. 3A, according to an embodiment of the present invention.
Figure 3C:
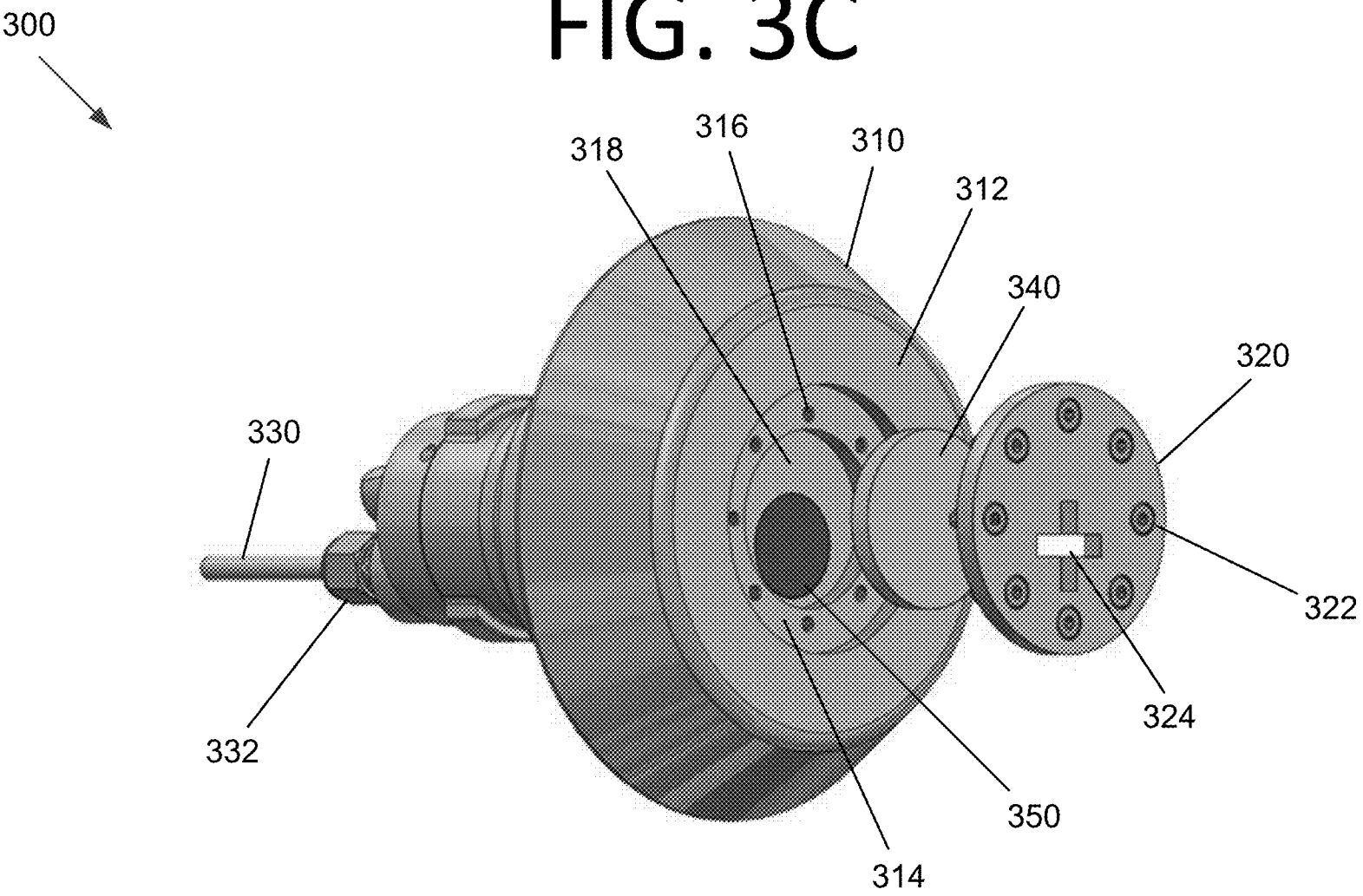
FIG. 3C is another partially separated side perspective view illustrating the spindle of FIG. 3A, according to an embodiment of the present invention.

FIGS. 3A-C illustrate a spindle 300, according to an embodiment of the present invention. Spindle 300 may be constructed from stainless steel, hardened aluminum, titanium, or any other sufficiently rugged metal or alloy without deviating from the scope of the invention. Spindle 300 includes a spindle body 310 with a flat front face portion 312. Spindle body 310 also includes a launcher plate recess 314 that houses a launcher plate 320. Launcher plate 320 is affixed to spindle body 310 via bolts 322 attached through threaded holes 316. Microwave energy exits spindle 300 towards a receiver (not shown) via an opening 324, which is in the shape of a "plus" in this embodiment.

A microwave transmission cable 330 provides microwave energy from a microwave generator (not shown) and is affixed to spindle 300 via a nut 332. Microwave transmission cable 330 is operably connected to a driver 350 (e.g., a printed circuit board including a planar antenna). A ceramic plate 340 covers driver 350 and is housed within a plate recess 318. Launcher plate 320 covers ceramic plate 340.

Driver 350 can broadcast through ceramic plate 340 and then on to opening 324, which re-radiates the microwave energy to the receiver. In some embodiments, a direct connection is provided between driver 350 and opening 324, and ceramic plate 340 may not be present. Opening 324 is a style of microwave broadcasting element. In this case, driver 350 emanates microwave radiation into the space between opening 324 and driver 350 that is filled by ceramic plate 340 (also called a "window" herein, although ceramic plate 340 may be opaque). The geometry of opening 324 is chosen in this embodiment to rebroadcast the energy into the breech volume. In particular, the cross pattern circularly polarizes the rebroadcast energy, which may protect ceramic plate 340, driver 350, and other "upstream" elements.

Figure 4A:
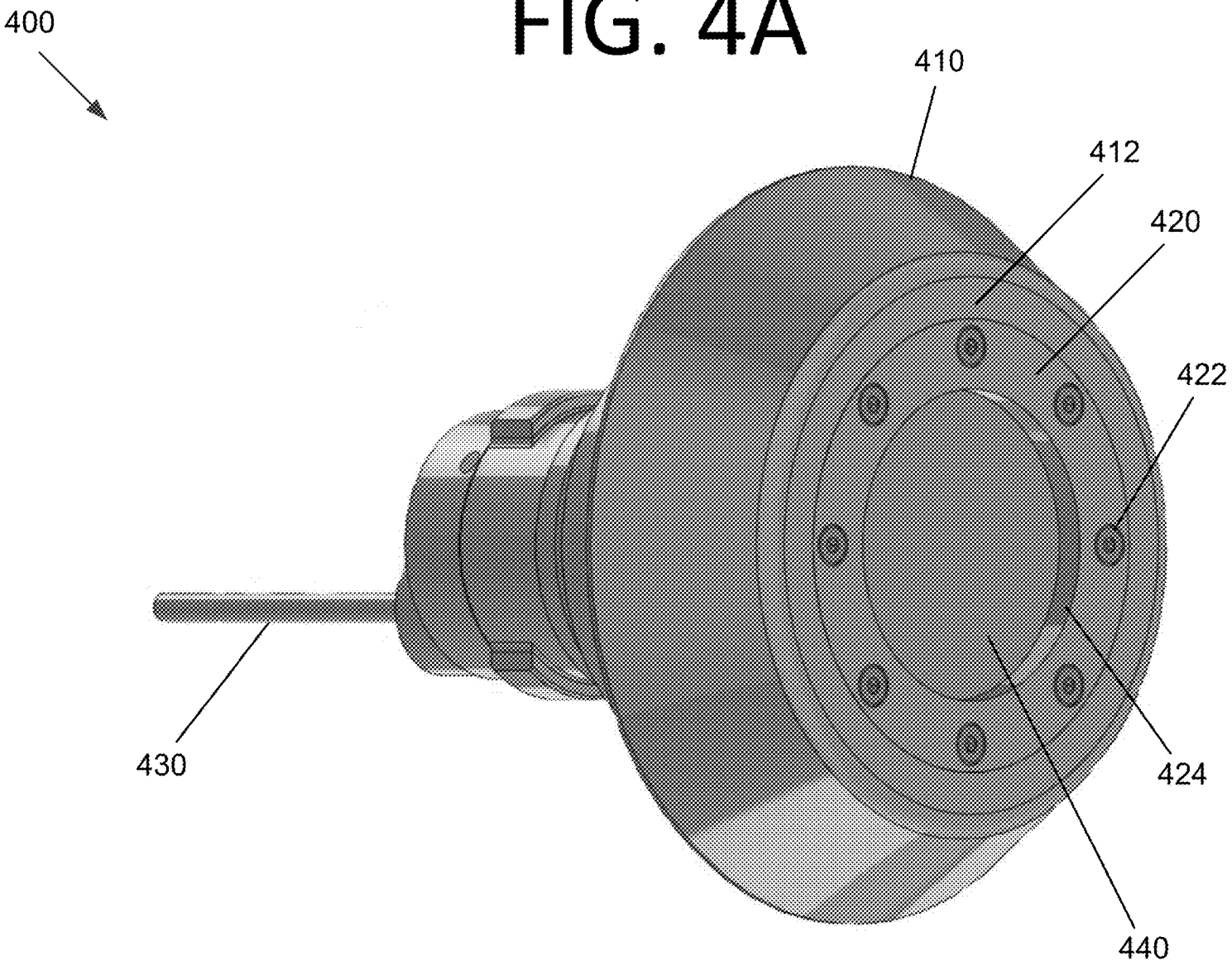
FIG. 4A is a side perspective view illustrating a spindle, according to an embodiment of the present invention.
Figure 4B:
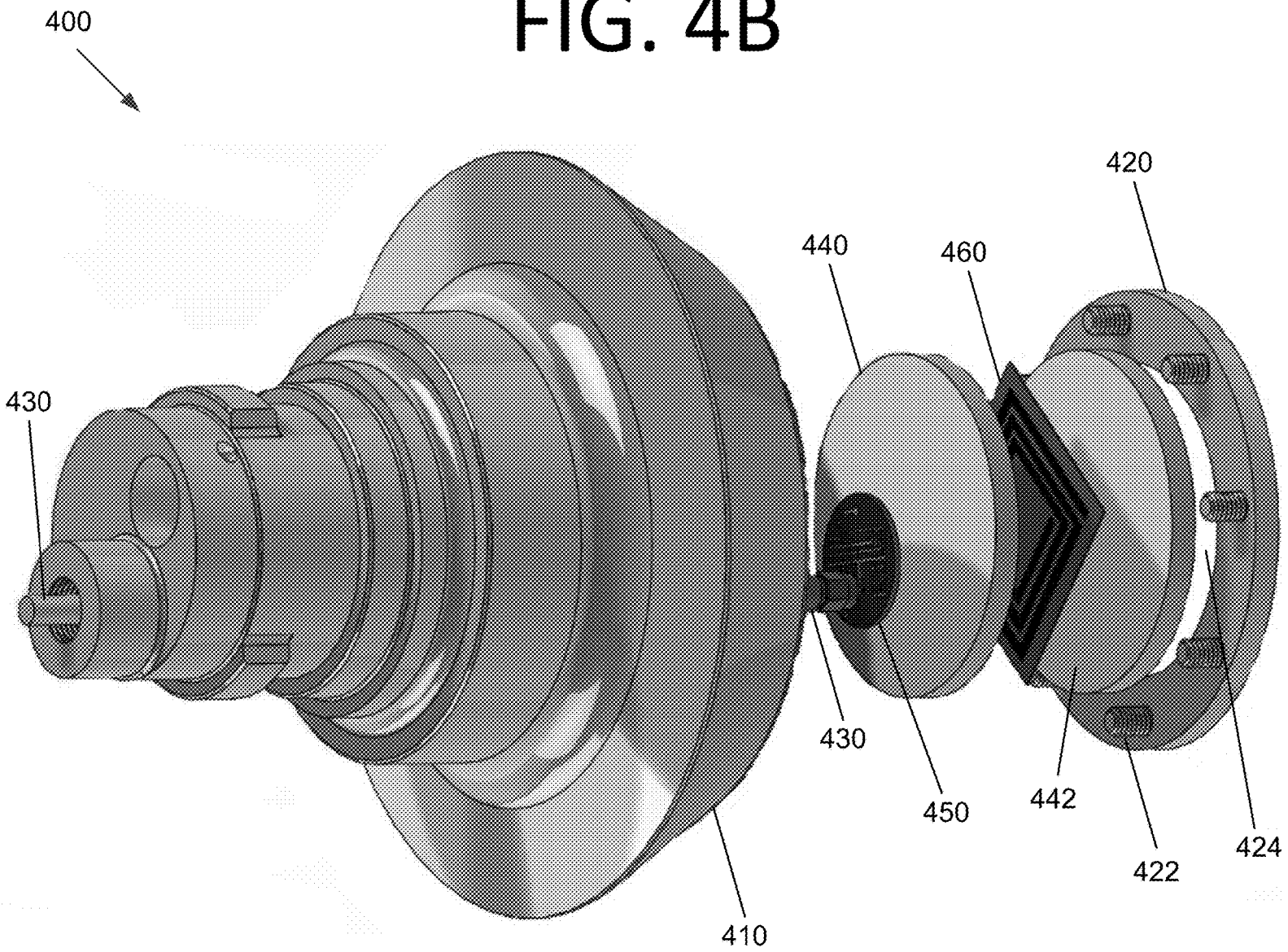
FIG. 4B is a partially separated side perspective view illustrating the spindle of FIG. 4A, according to an embodiment of the present invention.
Figure 4C:
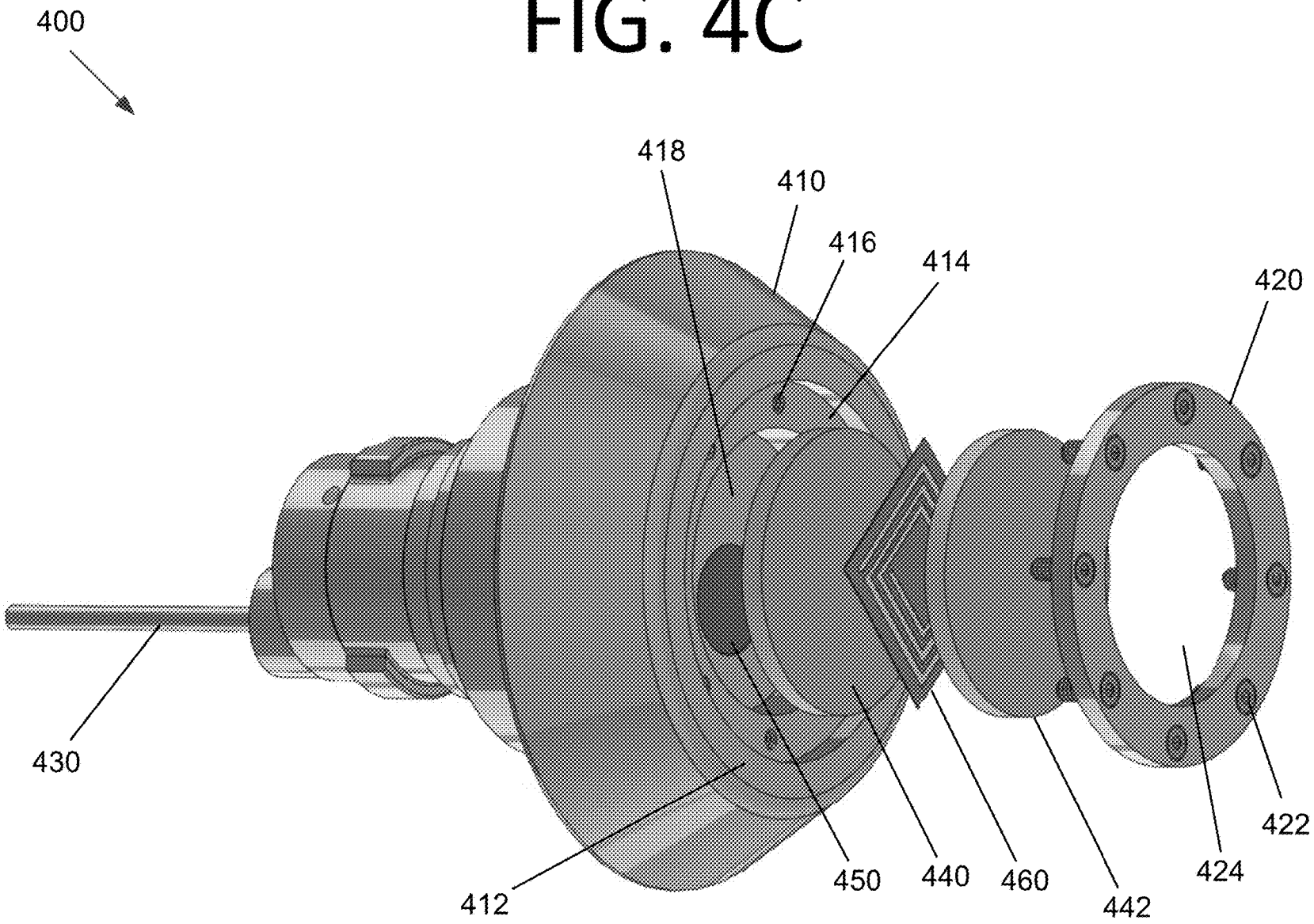
FIG. 4C is another partially separated side perspective view illustrating the spindle of FIG. 4A, according to an embodiment of the present invention.
Figure 5A:
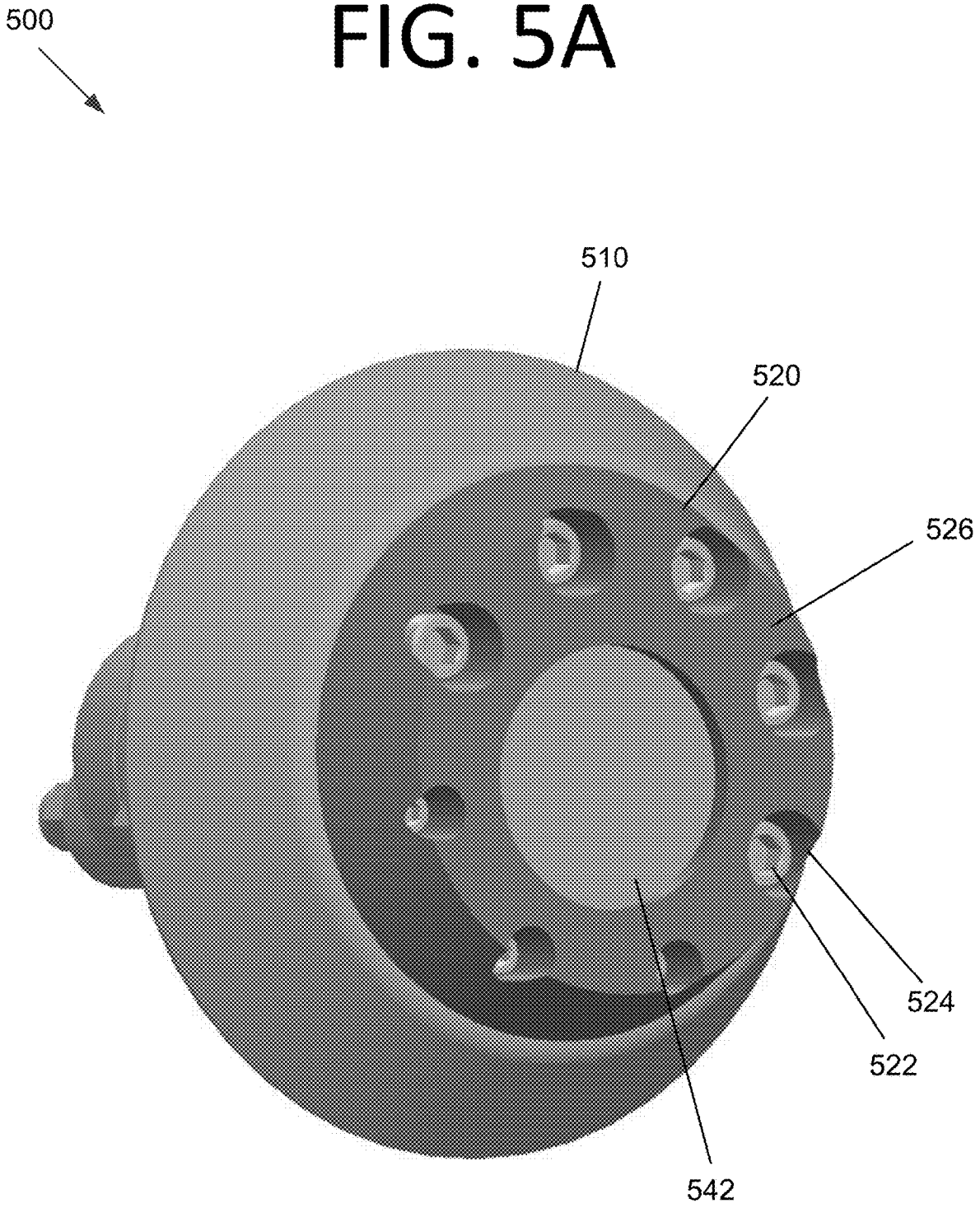
FIG. 5A is a side perspective view illustrating a hardened spindle, according to an embodiment of the present invention.
Figure 5B:
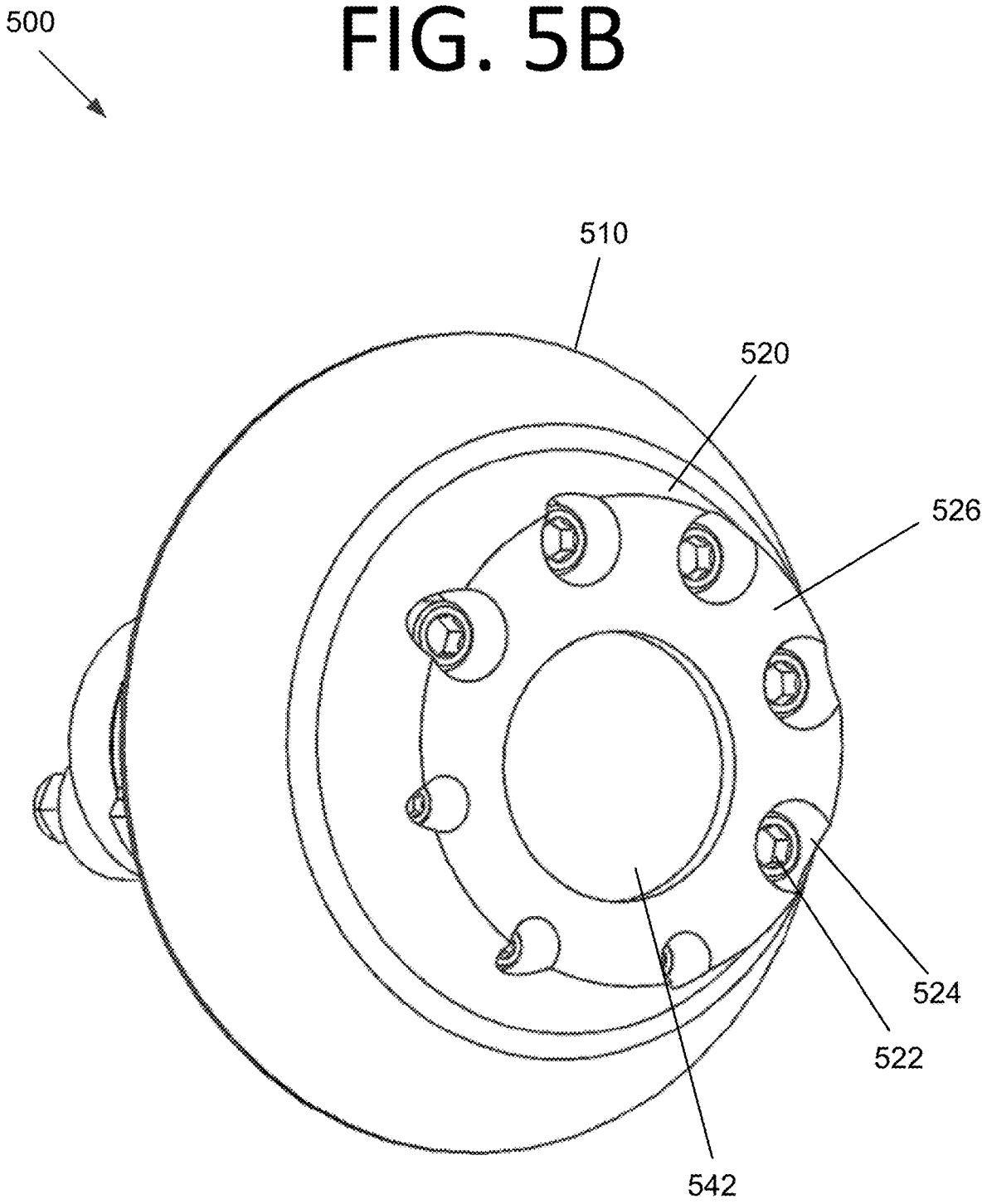
FIG. 5B is a wireframe side perspective view illustrating the hardened spindle of FIG. 5A, according to an embodiment of the present invention.
Figure 5C:
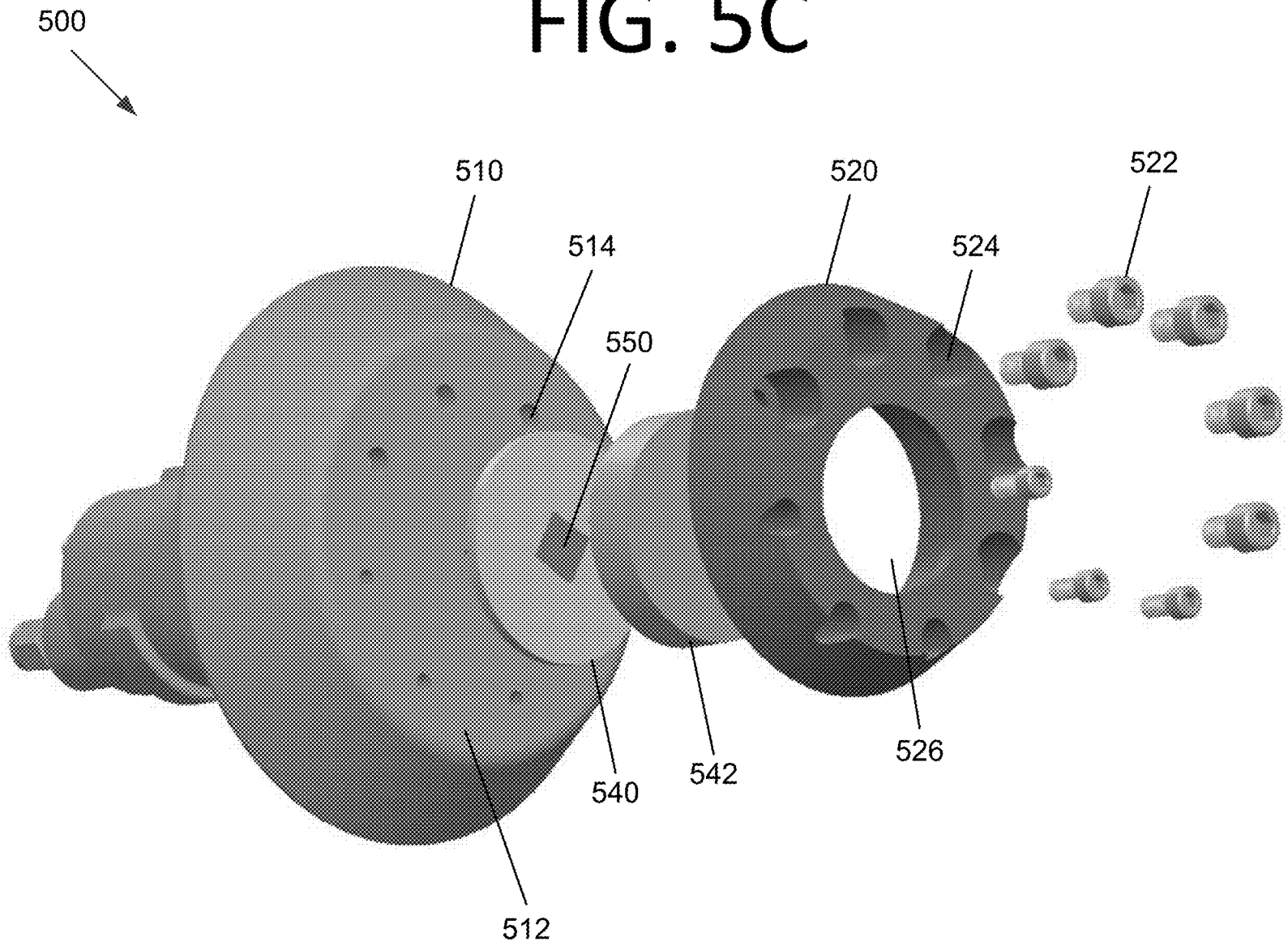
FIG. 5C is an exploded perspective view illustrating the hardened spindle of FIG. 5A, according to an embodiment of the present invention.
Figure 5D:
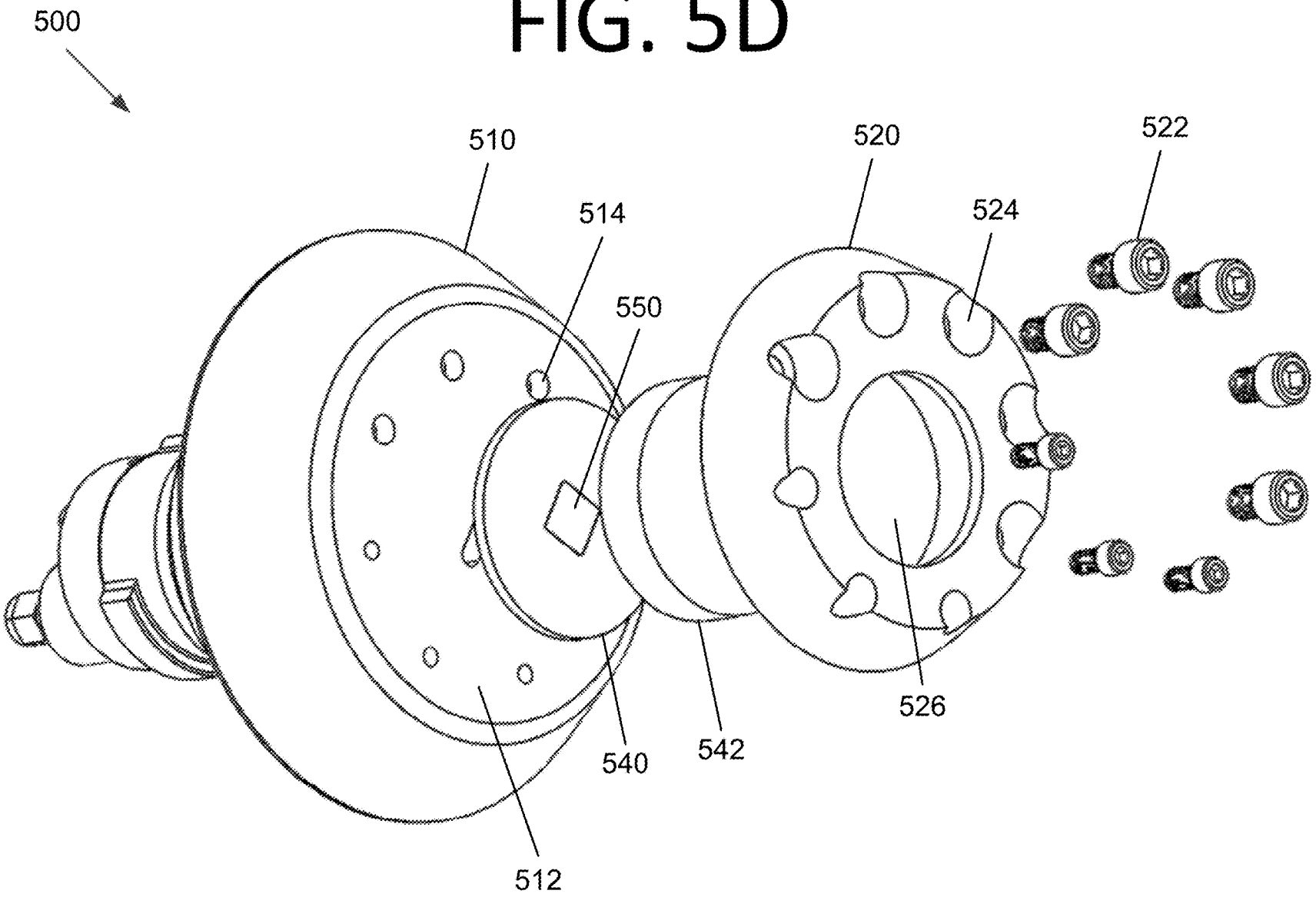
FIG. 5D is a wireframe exploded perspective view illustrating the hardened spindle of FIG. 5A, according to an embodiment of the present invention.
Figure 5E:
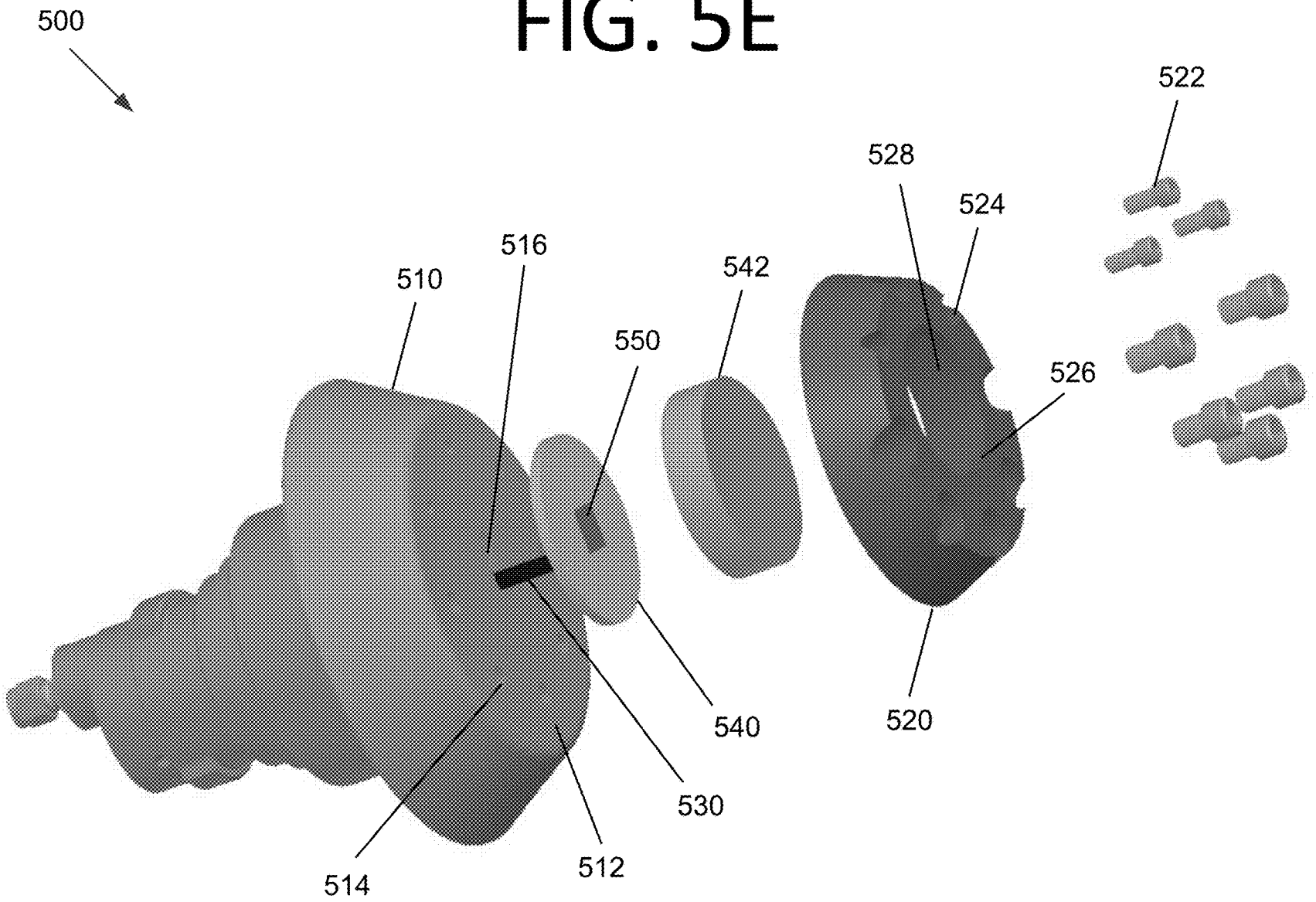
FIG. 5E is another exploded perspective view illustrating the hardened spindle of FIG. 5A, according to an embodiment of the present invention.
Figure 5F:
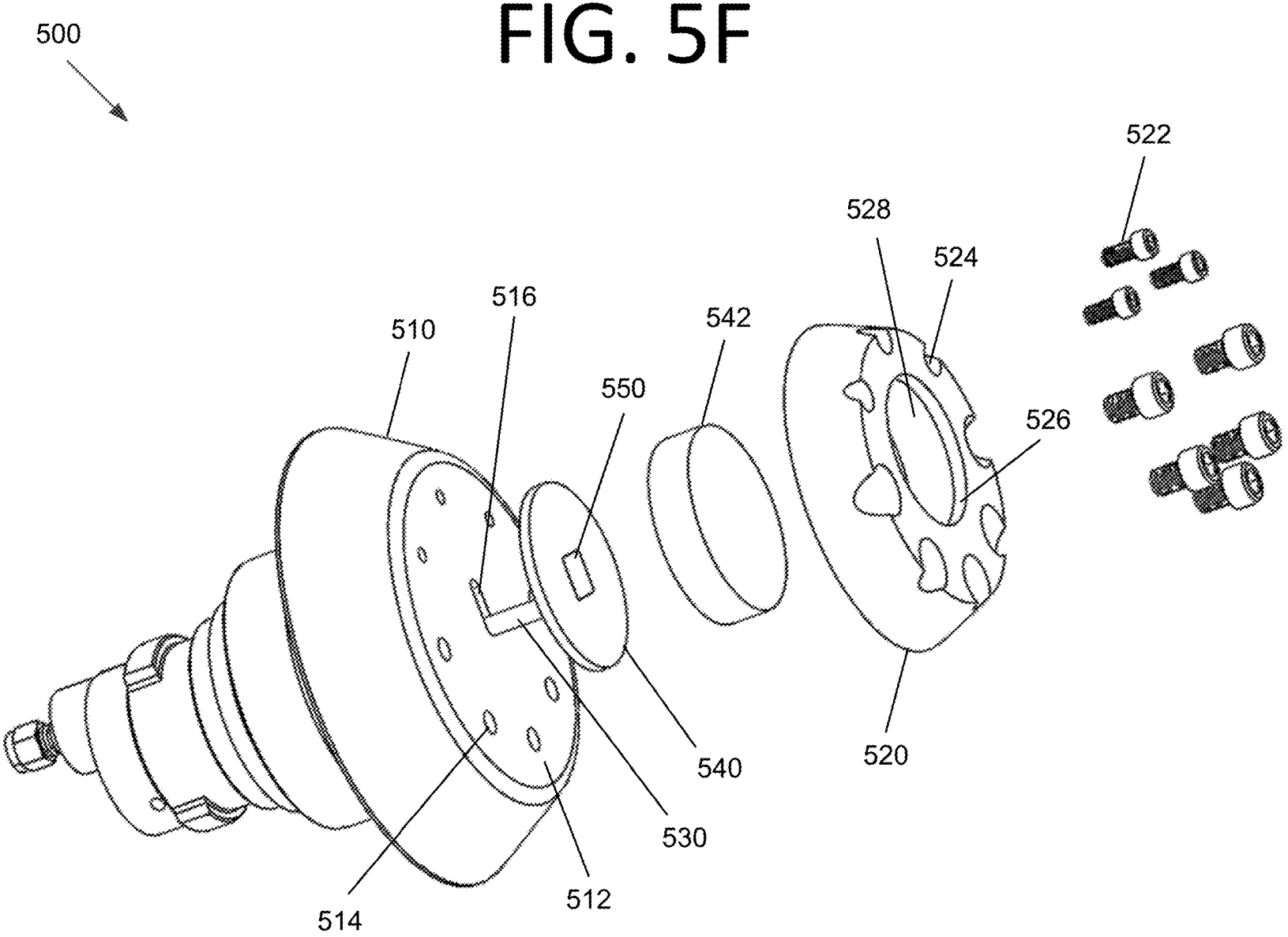
FIG. 5F is a wireframe exploded perspective view of the orientation of FIG. 5E illustrating the hardened spindle of FIG. 5A, according to an embodiment of the present invention.
Figure 5G:
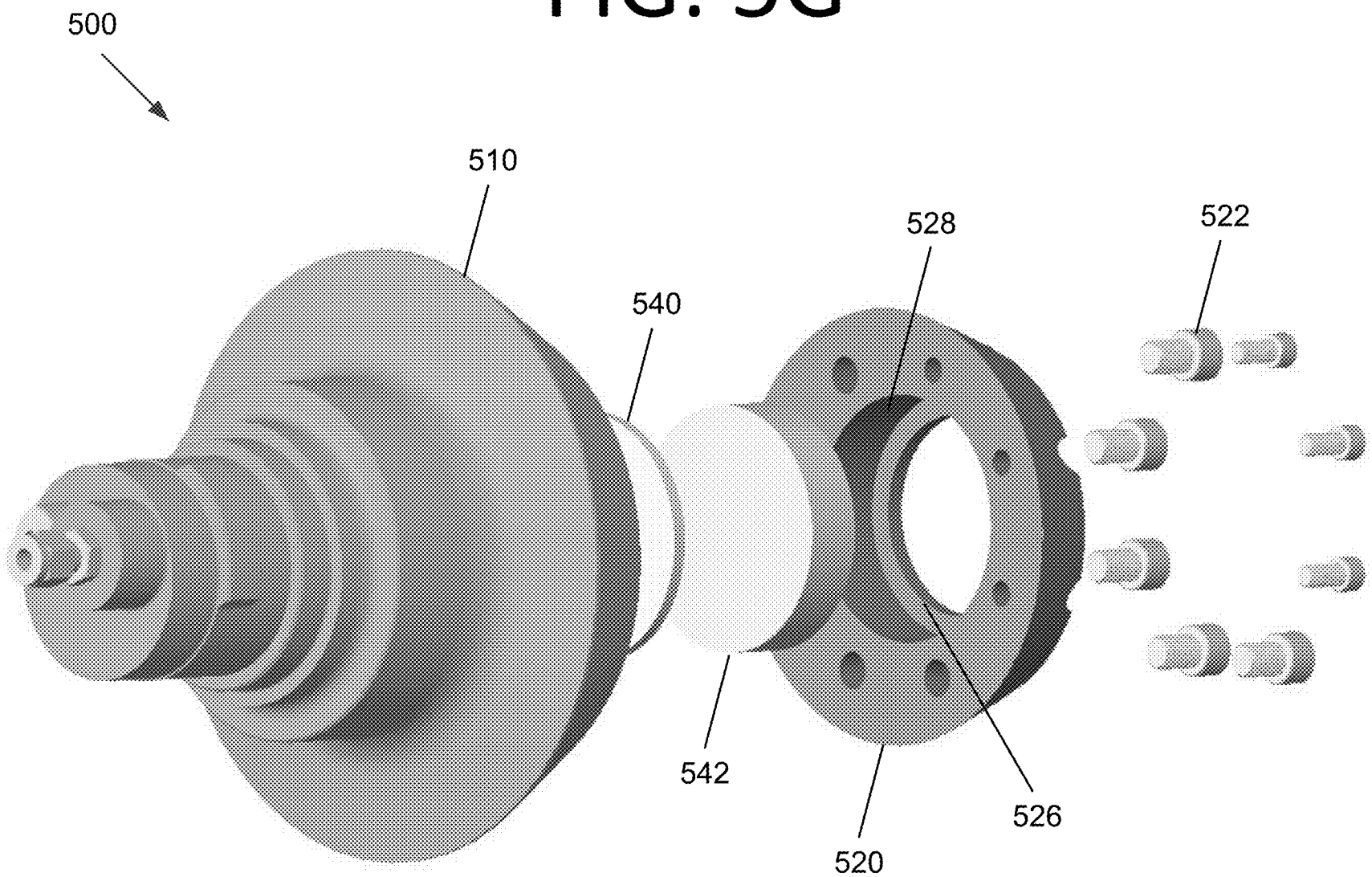
FIG. 5G is yet another exploded perspective view illustrating the hardened spindle of FIG. 5A, according to an embodiment of the present invention.
Figure 5H:
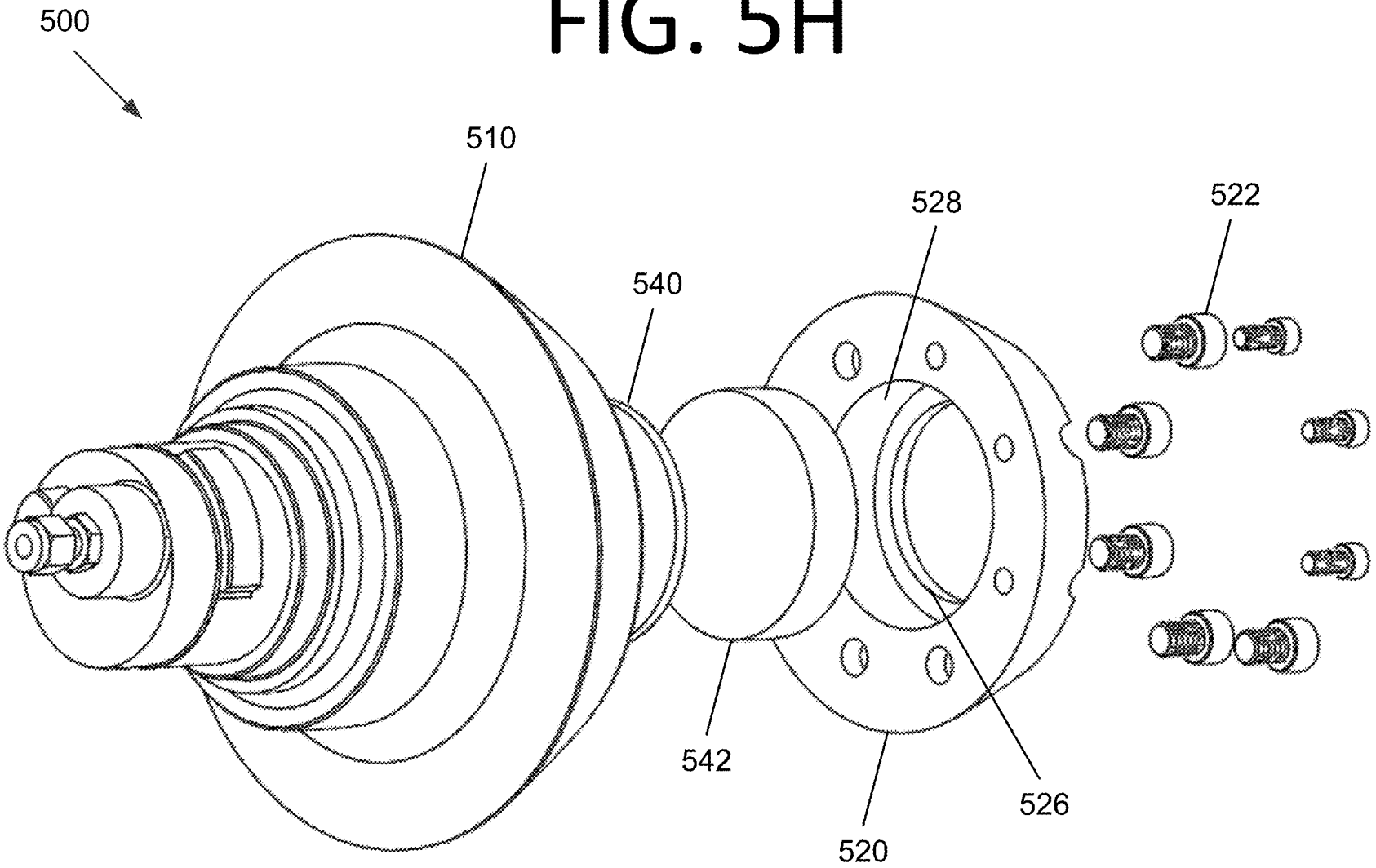
FIG. 5H is a wireframe exploded perspective view of the orientation of FIG. 5G illustrating the hardened spindle of FIG. 5A, according to an embodiment of the present invention.

FIGS. 4A-C illustrating a spindle 400, according to an embodiment of the present invention. Spindle 400 may be constructed from stainless steel, hardened aluminum, titanium, or any other sufficiently rugged metal or alloy without deviating from the scope of the invention. Spindle 400 includes a spindle body 410 with a flat front face portion 412. Spindle body 410 also includes a plate containment ring recess 414 that houses a plate containment ring 420. Plate containment ring 420 is affixed to spindle body 410 via bolts 422 attached through threaded holes 416. Microwave energy exits spindle 400 towards a receiver (not shown) through opening 424 in plate containment ring 420.

A microwave transmission cable 430 provides microwave energy to spindle 400 from a microwave generator (not shown). Microwave transmission cable 430 is operably connected to a driver 450 (e.g., a printed circuit board including a planar antenna). An inner ceramic plate 440 covers driver 450 and is housed within a plate recess 418. An antenna 460 is sandwiched between inner ceramic plate 440 and an outer ceramic plate 442. In this embodiment, antenna 460 is a PCB. Driver 450 can broadcast through inner ceramic plate 440 and then on to antenna 460. Antenna 460 re-radiates the microwave energy through outer ceramic plate 462 and on to the receiver through opening 424.

In some embodiments, outer ceramic plate 442 may experience 50,000 to 70,000 pounds per square inch (psi) when the charge(s) ignite. This may place too much of a compressive force for conventional dielectrics to survive without inner ceramic plate 440. Thus, two ceramic plates 440, 442 are used in this embodiment. In certain embodiments, antenna 460 is printed directly on inner ceramic plate 440 to mitigate against damage to its printed circuit board (PCB). In some embodiments, supports (not shown) may be included between ceramic plates 440, 442 to reduce compressive forces on antenna 460.

FIGS. 5A-H illustrate a hardened spindle 500, according to an embodiment of the present invention. Spindle 500 may be constructed from stainless steel, hardened aluminum, titanium, or any other sufficiently rugged metal or alloy without deviating from the scope of the invention. Spindle 500 includes a spindle body 510 with a flat front face portion 512. Spindle body 510 also includes threaded holes 514.

A launcher plate 520 is affixed to flat front face portion 512 of spindle body 512 via bolts 522 and threaded holes 514. Heads of bolts 522 are within respective bolt recesses 524 of launcher plate 520. Microwave energy exits spindle 500 towards a receiver (not shown) via an opening 526. A microwave transmission cable 530 extends through spindle 500 and is operably connected to a driver 550 printed on or housed within an inner ceramic plate 540. An outer ceramic plate 542 covers driver 550 and is housed within a ceramic plate recess 528 of launcher plate 520, which covers inner ceramic plate 540 and outer ceramic plate 542.

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. A spindle for a microwave ignition system, comprising:
a spindle body;
a microwave power source provided through the spindle body;
a driver configured to emit microwave energy, the driver operably connected to the microwave power source;
a first ceramic plate covering the driver; and
a launcher plate comprising a ceramic plate recess, the ceramic plate recess housing the first ceramic plate, wherein
the spindle comprises a front face portion, and
the launcher plate abuts the front face portion of the spindle.

2. The spindle of claim 1, wherein
the launcher plate comprises an opening through which a portion of the first ceramic plate is exposed, and
the spindle is configured to transit microwave energy through the opening.

3. The spindle of claim 1, wherein the front face portion is flat.

4. The spindle of claim 1, further comprising:
a second ceramic plate comprising the driver.

5. The spindle of claim 4, wherein the second ceramic plate abuts the first ceramic plate.

6. The spindle of claim 1, wherein the microwave power source comprises a cable.

7. A spindle, comprising:
a microwave power source;
a driver configured to emit microwave energy, the driver operably connected to the microwave power source;
an inner ceramic plate housing the driver;
an outer ceramic plate covering the driver and the inner ceramic plate; and
a launcher plate comprising a ceramic plate recess, the ceramic plate recess housing the outer ceramic plate ceramic plate, wherein the spindle comprises a front face portion, and the launcher plate abuts the front face portion of the spindle.

8. The spindle of claim 7, wherein the ceramic plate recess also houses the inner ceramic plate.

9. The spindle of claim 7, wherein the launcher plate comprises an opening through which a portion of the outer ceramic plate is exposed, and the spindle is configured to transit microwave energy through the opening.

10. The spindle of claim 7, wherein the front face portion is flat.

11. The spindle of claim 7, wherein the inner ceramic plate abuts the outer ceramic plate.

12. The spindle of claim 7, wherein the microwave power source comprises a cable.

13. A gun spindle, comprising:

a driver configured to emit microwave energy;

an inner ceramic plate housing the driver;

an outer ceramic plate covering the driver and the inner ceramic plate; and a launcher plate comprising a ceramic plate recess, the ceramic plate recess housing the outer ceramic plate, wherein the gun spindle comprises a front face portion, and the launcher plate abuts the front face portion of the gun spindle.

14. The gun spindle of claim 13, wherein the ceramic plate recess also houses the inner ceramic plate.

15. The gun spindle of claim 13, wherein the launcher plate comprises an opening through which a portion of the outer ceramic plate is exposed, and the gun spindle is configured to transit microwave energy through the opening.

16. The gun spindle of claim 13, wherein the front face portion is flat.

17. The gun spindle of claim 13, wherein the inner ceramic plate abuts the outer ceramic plate.

18. The gun spindle of claim 13, further comprising:

a microwave power source provided through the spindle body, wherein the driver is operably connected to the microwave power source.

* * * * *